US007997917B1

(12) United States Patent
O'Neill et al.

(10) Patent No.: US 7,997,917 B1
(45) Date of Patent: Aug. 16, 2011

(54) ENVIRONMENTALLY SEALED ELECTRICAL CONNECTOR

(75) Inventors: John J. O'Neill, Wichita, KS (US); Christopher E. Schaefer, Dayton, OH (US)

(73) Assignee: Omni Aerospace, Inc., Wichita, KS (US)

( * ) Notice: Subject to any disclaimer, the term of this patent is extended or adjusted under 35 U.S.C. 154(b) by 0 days.

(21) Appl. No.: 12/913,161

(22) Filed: Oct. 27, 2010

(51) Int. Cl.
*H01R 13/52* (2006.01)

(52) U.S. Cl. ..... 439/275

(58) Field of Classification Search ..... 439/271–275, 439/519, 587–589
See application file for complete search history.

(56) References Cited

U.S. PATENT DOCUMENTS 3,818,420 A * 6/1974 Barr ..... 439/261
4,166,664 A * 9/1979 Herrmann, Jr. ..... 439/258
4,193,655 A * 3/1980 Herrmann, Jr. ..... 439/166
4,299,434 A 11/1981 Ishikawa
4,411,491 A 10/1983 Larkin et al.
4,874,326 A 10/1989 Marolda, Jr.
5,595,496 A 1/1997 Konda et al.
5,967,829 A 10/1999 Shinchi
6,010,348 A * 1/2000 Alden ..... 439/274
6,071,147 A * 6/2000 Tsukamoto ..... 439/587
6,142,825 A 11/2000 Shinchi
6,200,164 B1 * 3/2001 Martin et al. ..... 439/595
6,250,972 B1 6/2001 Shinchi et al.
6,361,342 B1 * 3/2002 Cox ..... 439/275
7,211,725 B1 5/2007 Tait
7,229,313 B1 6/2007 Keckler

* cited by examiner

*Primary Examiner* — Chandrika Prasad
(74) *Attorney, Agent, or Firm* — Thomas E. Lees, LLC

(57) ABSTRACT

An environmentally sealed electrical connector comprises a plug connector and a complimentary socket connector. The plug connector includes a plug body, a plug shell, a plug boot, a backshell and an interfacial seal. The socket connector includes a socket body, a socket shell, a socket boot and a backshell. The plug boot and the socket boot each have a plurality of rupturable features, each feature in register with a corresponding aperture through the corresponding connector body. The interfacial seal seats between the plug connector and socket connector when the plug connector is mated to the socket connector. The interfacial seal also has a plurality of rupturable features corresponding to a predetermined contact layout. Thus, when the socket connector is mated with the plug connector, a connector is provided, which prevents contaminants from penetrating the connection.

20 Claims, 6 Drawing Sheets

ENVIRONMENTALLY SEALED ELECTRICAL CONNECTOR

BACKGROUND

The present invention relates to electrical connectors, and in particular, to electrical connectors that interconnect a plurality of wires so as to provide environmentally sealed electrical connections.

It is often necessary to interconnect wires to form an electrical connection. In this regard, an electrical connector is often utilized to electrically join wires together or to otherwise electrically interconnect a wire or bundle of wires to additional circuitry. In practice, a connector typically comprises complimentary male and female connector components. Each connector component may be coupled to a terminal end of one or more wires in a corresponding wire bundle, or to a circuit or other arrangement. In use, a plurality of simultaneous electrical connections may be readily made by plugging the complimentary male and female connector components together. Correspondingly, an electrical connection between the connector components may be broken by disconnecting the male connector component from the female connector component.

BRIEF SUMMARY

According to various aspects of the present invention, a liquid-tight, e.g., waterproof, electrical connector comprises a plug connector and a complimentary socket connector. The plug connector includes a plug body, a plug boot and an interfacial seal. For instance, a first mono body defining a plug body has a plug-side connector face, a wire entry face and a plurality of apertures that pass through the first mono body between the wire entry face and the plug-side connector face in a pattern corresponding to a predetermined contact layout. The plug boot extends over a portion of the first mono body so as to completely cover the wire entry face. Moreover, the plug boot has a plurality of rupturable features, each feature in register with a corresponding aperture at the wire entry face of the plug body. Similarly, the interfacial seal has a plurality of rupturable features, each feature in register with a corresponding aperture at the plug side connector face of the plug body. A plug backshell may be used that couples to the plug connector so as to cover the plug boot and the plug connector.

Correspondingly, the socket connector includes a socket body and a socket boot. For instance, a second mono body defining a socket body has a socket-side connector face, a socket-side wire entry face and a plurality of apertures that pass through the second mono body between the socket-side wire entry face and the socket-side connector face in a pattern complimentary to the corresponding predetermined contact layout. The socket boot extends over a portion of the second mono body so as to completely cover the socket-side wire entry face. The socket boot has a plurality of rupturable features, each feature in register with a corresponding aperture at the socket-side wire entry face. A socket backshell may be used that couples to the second mono body so as to cover the socket boot and the socket connector.

Further, the interfacial seal seats between the plug-side connector face of the first mono body and the socket-side connector face of the second mono body when the plug connector is mated to the socket connector. Moreover, the interfacial seal deforms when the plug connector is coupled to the socket connector so as to form a water-tight seal at the interface between the plug body and the socket body.

According to further aspects of the present invention, an environmentally sealed electrical connector comprises a plug connector and a socket connector. The plug connector includes a two-component plug body having first component including a plug-side wire entry face bonded to a second component including a plug-side connector face to realize a mono body that prevents contaminants from penetrating between the bonded interface of the first and second components. A plurality of apertures pass through the plug body between the wire entry face and the plug-side connector face in a pattern corresponding to a predetermined contact layout.

Similarly, the socket connector includes a two-component socket body having first component including a socket-side wire entry face bonded to a second component including a socket-side connector face to realize a mono body that prevents leaks from penetrating between the bonded interface of the first and second components. A plurality of apertures pass through the socket body between the wire entry side face and the socket-side connector face in a pattern complimentary to the corresponding predetermined contact layout.

A first boot extends over a portion of the plug body to prevent contaminants from penetrating through the wire entry face of the plug body. In this regard, the first boot has a plurality of rupturable features, each feature in register with a corresponding aperture at the plug-side wire entry face. A first backshell may couple to the plug body so as to cover the first boot. Correspondingly, a second boot extends over a portion of the socket body to prevent contaminants from penetrating through the wire entry face of the socket body. The second boot has a plurality of rupturable features, each feature in register with a corresponding aperture at the wire entry face of the socket body. A second backshell may couple to the socket body so as to cover the second boot.

An interfacial seal seats between the plug-side connector face of the plug body and the socket-side connector face of the socket body, the interfacial seal having a plurality of rupturable features corresponding to the predetermined contact layout, such that when the plug body is mated with the socket body, the interfacial seal deforms to prevent contaminants from penetrating between the plug and socket bodies.

DETAILED DESCRIPTION

According to various aspects of the present invention, electrical connectors are provided that include plug and corresponding socket connector components. When the connector components are suitably mated, the electrical connections formed thereby are environmentally sealed so as to prevent contaminants such as moisture, water, liquids, dust, dirt, overmolding compounds, atmospheric borne and other contaminants from penetrating the connector. As such, the connector avoids degraded electrical performance due to contamination.

Moreover, electrical connectors are provided, according to various aspects of the present invention, that enable field repairs, and further allow for customizations, including customizations that call for using less than the total number of contact positions available in a corresponding contact layout associated with an electrical connector while maintaining an environmental seal.

Figure 1:
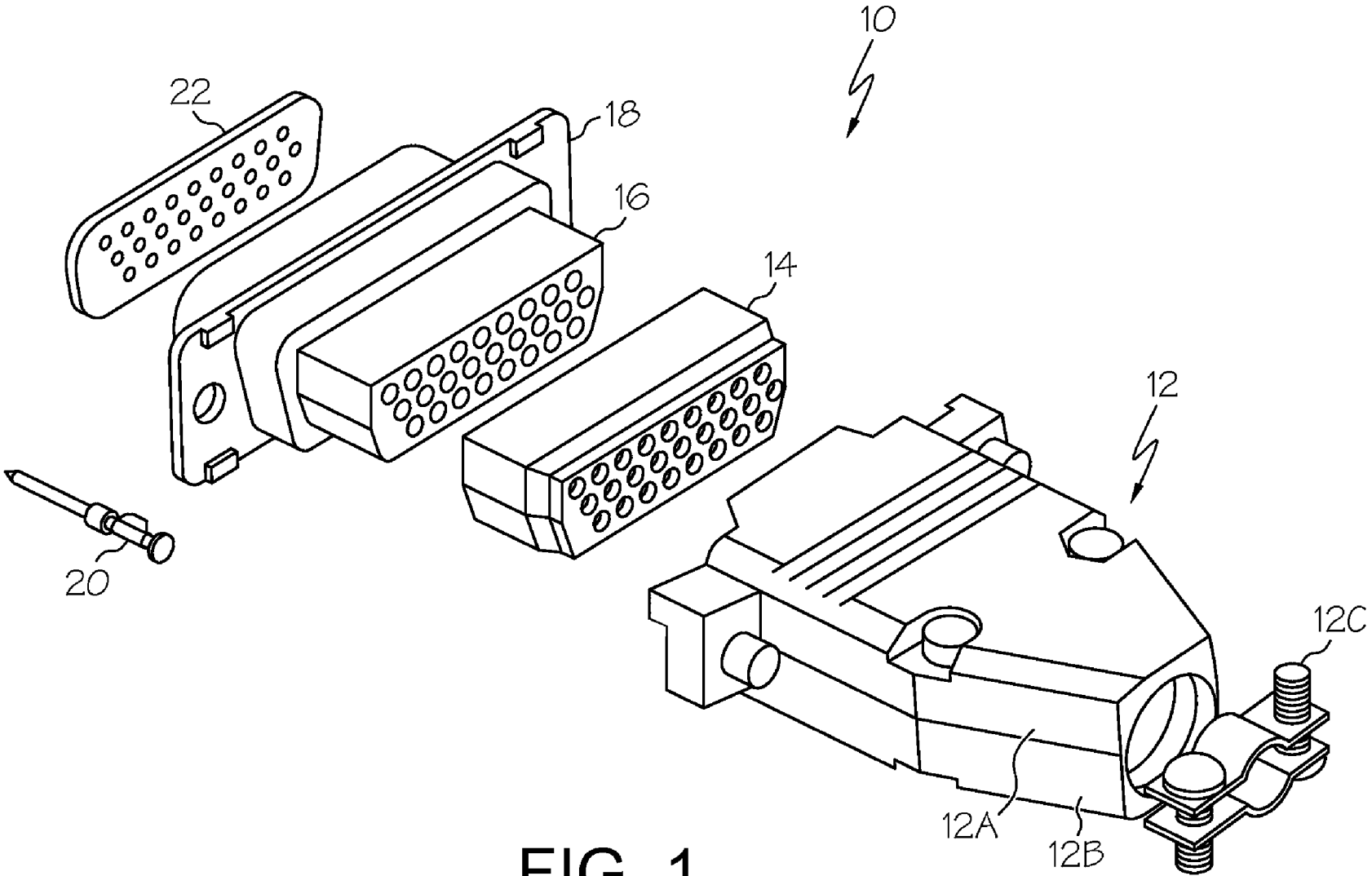
FIG. 1 is an illustration of an exemplary plug connector according to various aspects of the present invention.

Referring now to the drawings and in particular, to FIG. 1, a plug connector 10, or male connector, is illustrated according to various aspects of the present invention. The plug connector 10 is half of a connector mated pair assembly described more fully herein, and includes in general, a back shell 12, a boot 14, a plug body 16, a connector shell 18, one or more pin contacts 20 and an interfacial seal 22. The back shell 12 is optional, and may comprise for example, a clamshell assembly including components 12A and 12B that mate together over a portion of the body 16 and/or connector shell 18 during assembly, as will be described in greater detail herein. The back shell 12 may also include a strain relief clamp 12C to provide strain relief to a wire or wire bundle (not shown), that is passed through the back shell 12.

In use, an end portion of an interconnect, e.g., a wire bundle such as a plurality of individually insulated wires wrapped in a common sheath, are fed through the strain relief clamp 12C. Each wire is stripped at its terminal end, and a pin contact 20 is crimped about the bare wire. Each pin contact 20 is inserted through the boot 14, and through the plug body 16 at a designated position. When the pin is properly inserted, the tip end of the pin extends through the plug body 16 and the interfacial seal 22, which is aligned with the face of the plug body 16. The back shell 12 may then be firmly clamped over and secured to a portion of the plug body 16 and/or connector shell 18. In the absence of a backshell 12, the boot 14 may be adhered to the plug body 16 with adhesive or some other mechanical method.

Moreover, the boot 14 may be adhered to the plug body 16 regardless of whether the backshell 12 is utilized, e.g., to satisfy pressure sealing requirements of a particular application. Still further, the boot 14 may be bonded to the plug body 16 such as by multi-compound molding, ultrasonic welding, etc. As will be described in greater detail herein, the pin contacts 20 are arranged in a pattern corresponding to a predetermined contact layout. For instance, the illustrated plug connector 10 is implemented as a subminiature D-style connector (Dsub connector). However, other arrangements are possible.

As noted above, the backshell 12 is optional. By way of illustration, the backshell 12 may not be required when using seals for overmolding dams to prevent overmolding from contaminating the electrical connections. In this case there would be no backshell 12 as the overmolding would provide that function.

Figure 2:
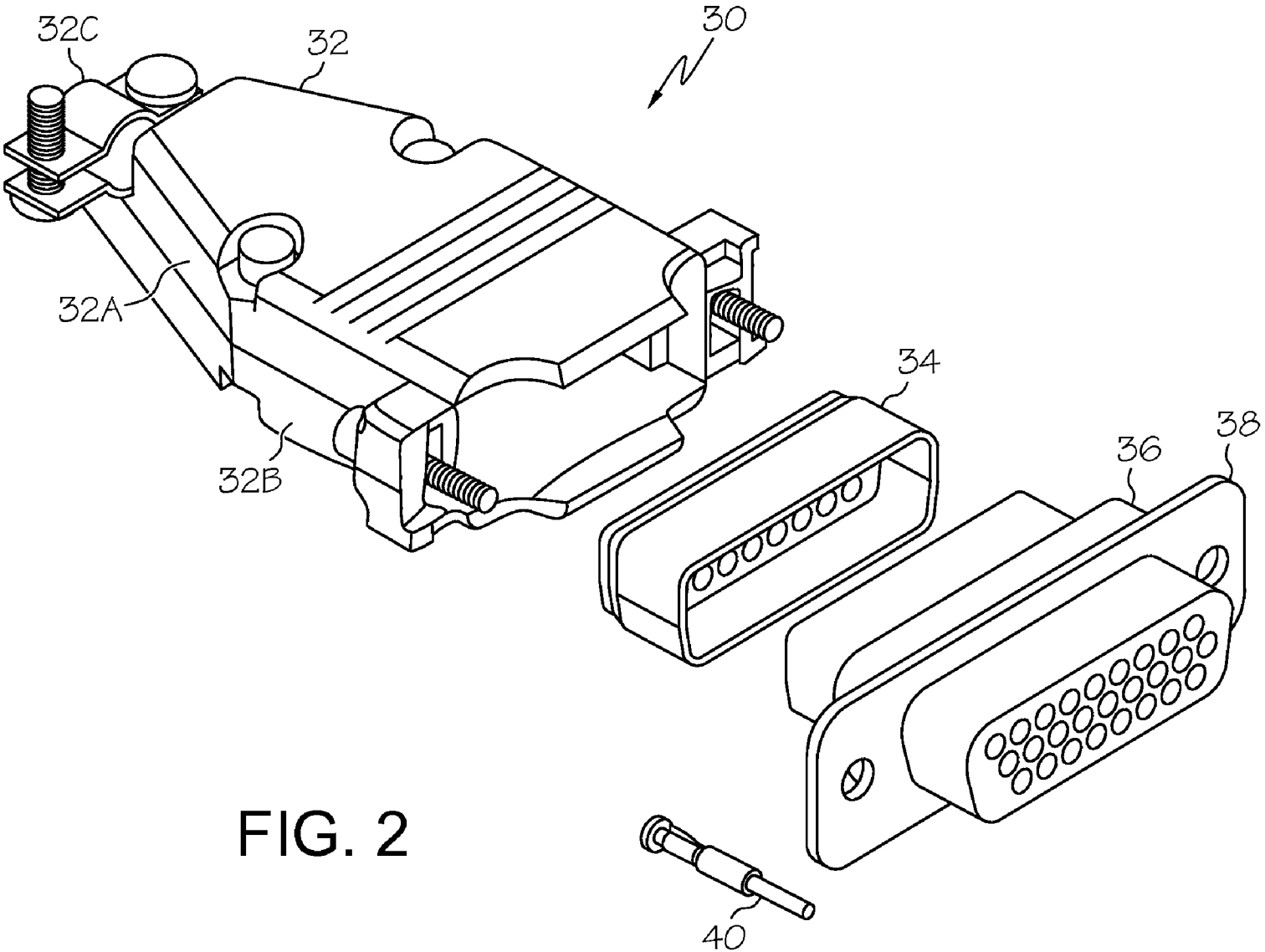
FIG. 2 is an illustration of an exemplary socket connector according to various aspects of the present invention.

Referring to FIG. 2, a socket connector 30, or female connector, is illustrated according to various aspects of the present invention. The socket connector 30 is the second half of the connector assembly described more fully herein, and includes in general, a back shell 32 a boot 34, a socket body 36, a body shell 38 and one or more socket contacts 40. The back shell 32 may comprise for example a clamshell assembly including clamshell components 32A and 32B that mate together over a portion of the body 36 and/or body shell 38 in a manner analogous to the back shell 12 described with reference to FIG. 1. The back shell 32 may also include a strain relief clamp 32C to provide strain relief to an interconnect, e.g., a wire bundle (not shown) that is passed through the back shell 32. The illustrated socket connector 30 is also implemented as a subminiature D-style connector (Dsub connector) that corresponds with the plug connector 10 of FIG. 1. However, other arrangements are possible.

In use, the socket connector 30 is assembled in a manner analogous to the assembly of the plug connector 10 described above with reference to FIG. 1. That is, for example, an end portion of a wire bundle, e.g., typically a plurality of individually insulated wires wrapped in a common sheath, are fed through the strain relief clamp 32C. Each wire is stripped at its terminal end, and a socket contact 40 is crimped about the bare wire. Each socket contact 40 is inserted through the boot 34, and into the plug body 36. The back shell 32 is then firmly clamped over and secured to a portion of the socket body 36 and/or body shell 38, if the backshell 32 is utilized.

As will be described in greater detail herein, the socket contacts 40 are arranged in a complimentary pattern corresponding to a predetermined contact layout. In this regard, the positioning of the socket contacts 40 installed in the socket connector 30 should mirror the positioning of the pin contacts 20 installed in the plug connector 10 so that when the plug connector 10 is mated with the socket connector 30, each installed pin contact 20 mates with a corresponding socket contact 40.

In a manner analogous to that described with reference to FIG. 1, in the absence of a backshell 32, the boot 34 may be adhered to the socket body 36 with adhesive or some other mechanical method. Moreover, the boot 34 may be adhered to the socket body 36, e.g., to satisfy pressure sealing requirements of a particular application. Still further, the boot 34 may be bonded to the socket body 36 such as by multi-compound molding, ultrasonic welding, etc.

Also in a manner analogous to that described above with reference to FIG. 1, the backshell 32 is optional. By way of illustration, the backshell 32 may not be required when using seals for overmolding dams to prevent overmolding from contaminating the electrical connections. In this case there would be no backshell 32 as the overmolding would provide that function.

Figure 3:
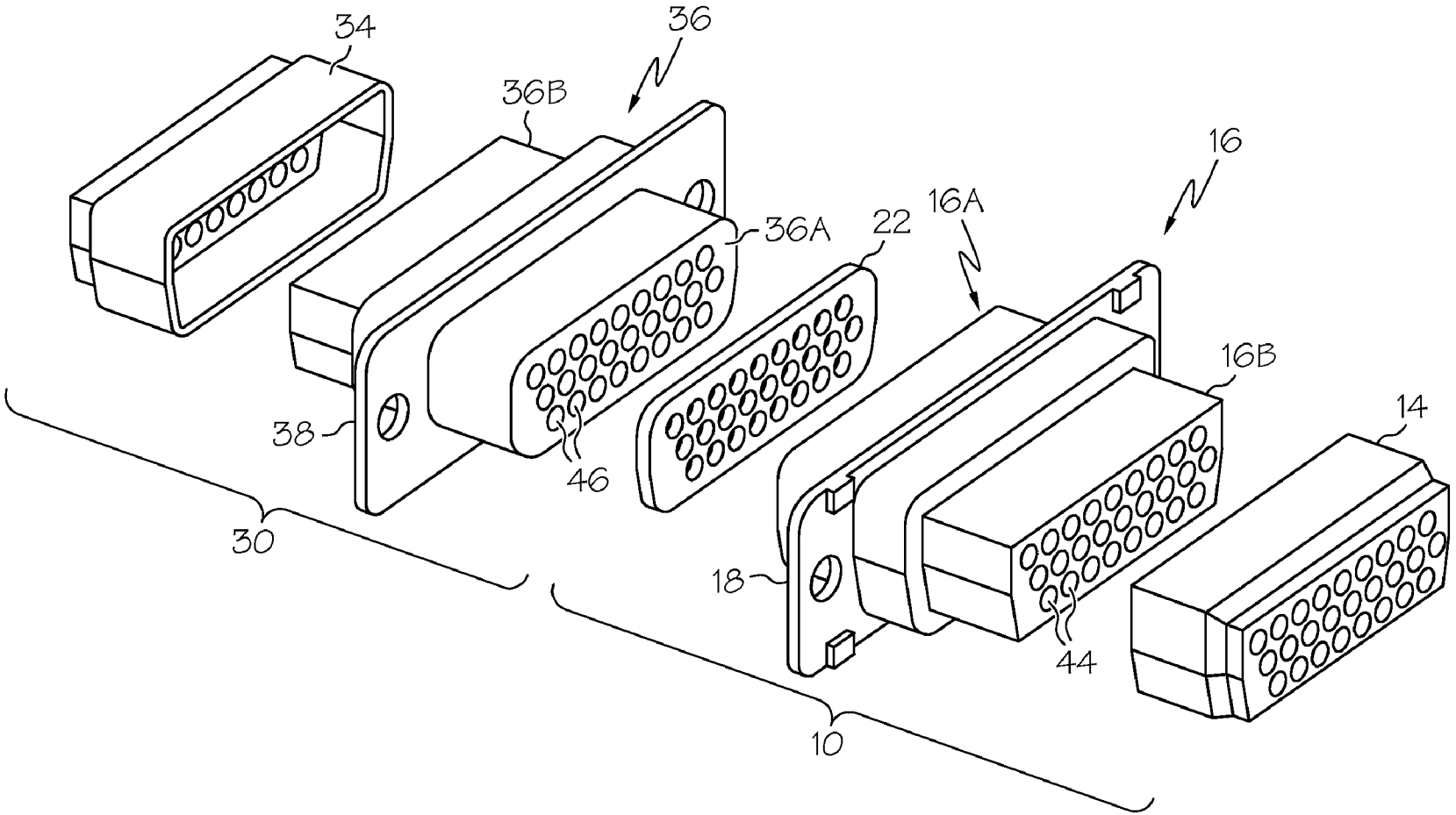
FIG. 3 is an illustration of select components of a plug connector in cooperation with select components of socket connector according to various aspects of the present invention.

Referring to FIG. 3, select components of the plug connector 10 and socket connector 30 are illustrated according to various aspects of the present invention. The plug connector 10 and socket connector 30 are implemented in this illustrative example, as corresponding, mating subminiature D-style connector components.

The plug body 16 is implemented as a first mono body having a plug-side connector face 16A and a wire entry side face 16B. In this regard, the plug-side connector face 16A is directed towards the mating connector component. The plug-side wire entry face 16B faces the structure that interconnects to the plug component 10, e.g., a wire bundle, circuit or other structure. Correspondingly, the socket body 36 is implemented as a second mono body having a socket-side connector face 36A and a socket-side wire entry face 36B. In an analogous manner to the plug body 16, the socket-side connector face 36A is directed towards the mating connector component. The socket-side wire entry face 36B faces the structure that interconnects to the socket component 30, e.g., a wire bundle, circuit or other structure. By mono body, it is meant that the plug body is either a single component, or two or more components so integrally bonded or otherwise joined as to be liquid-tight along the seam of the intersection of the component(s) that make up the body, as ill be described in greater detail herein.

The connector shell 18, typically, a metal cover, circumscribes or otherwise covers at least a portion of the plug body 16. The connector shell 18 further provides a flange having a securing arrangement, e.g., an aperture through the flange on opposite sides of the plug body 16, for coupling and tightly securing the plug connector 10, as will be described below. Similarly, a socket shell 38, also typically a metal cover, circumscribes or otherwise covers at least a portion of the socket body 36 and provides a flange having a securing arrangement, e.g., an aperture through the flange on opposite sides of the socket body 36, for coupling and tightly securing the socket connector 30, as will be described below.

The connector shell 18 and corresponding socket shell 38 thus allow the plug connector 10 and socket connector 30 to be temporarily mechanically coupled. For instance, the plug connector 10 can be coupled to the socket connector 30 using thumb screws and corresponding threaded nuts, e.g., provided by the backshells 12, 32, which pass through the associated holes in the flanges of the connector shell 18 and socket shell 38 to pull and tighten the plug connector 10 towards the socket connector 30. Correspondingly, loosening and releasing the thumb screws from the threaded nuts facilitates decoupling the plug connector 10 from the socket connector 30. Other arrangements may alternatively be utilized to secure the connector 10 to the socket connector 30.

The shell 18 may also include a hood, e.g., a metal extension portion that extends out from the plug-side connector face 16A. The hood further serves to protect the pin contacts 20 inserted into the plug body 16. Correspondingly, the shell 38 may comprise a metal shell that wraps around the body 36 up to the socket-side connector face 36A. The hood of the shell 18 mates with the corresponding shell 38 to align the socket-side connector face 36A of the socket body 36 to the plug-side connector face 16A.

The plug-side connector face 16A defines a portion of the plug body 16 that faces and mates with the corresponding socket-side connector face 36A of the socket body 36. The plug-side interconnect face 16B defines a portion of the plug body 16 that faces the plug boot 14, and corresponding back shell 12, illustrated in FIG. 1. Thus, a pin contact 20, as illustrated in FIG. 1, crimped to the end of a wire of a first wire bundle, passes through boot 14, through the plug-side interconnect face 16B through to the plug-side connector face 16A. Correspondingly, the socket-side wire entry face 36B defines a portion of the socket body 36 that faces the socket boot 34, and corresponding back shell 32, illustrated in FIG. 2. Thus, a socket contact 40 crimped to the end of a wire of a second wire bundle, passes through the boot 34, through the socket-side wire entry face 36B through to the socket-side connector face 36A. When the plug body 16 is mated with the socket body 36, each pin contact 20 mates with a corresponding socket contact 40 to form a desired electrical connection.

A plurality of apertures 44 pass through the first mono body 16 between the plug-side connector face 16A and the plug-side wire entry face 16B in a pattern corresponding to the predetermined contact layout. Similarly, a plurality of apertures 46 pass through the second mono body 36 between the socket-side connector face 36A and the socket-side interconnect face 36B in a pattern complimentary to the corresponding predetermined contact layout.

Although the illustrated plug body 16 is implemented with a 25 contact layout, any other configuration may be implemented. For instance, DSub connectors are commonly available in 9, 15, 25, 37, 50, etc., contact layouts.

The plug boot 14 defines a first boot of the illustrated connector system. The plug boot 14 extends over a portion of the first mono body 16. In an exemplary implementation, the first boot 14 extends over a portion of the first mono body 16 so as to completely cover and form a liquid-tight seal with regard to the plug-side interconnect face 16B. The plug boot 14 has a plurality of rupturable features corresponding to the predetermined contact layout. For instance, each feature may align in register with a corresponding aperture at the plug-side interconnect face 16B. However, initially, there are no holes or other apertures that extend entirely through the boot 14. In this regard, the plug boot 14 functions as a seal to seal the rear portion, or interconnect end, of the plug connector 10.

Likewise, the socket boot 34 defines a second boot of the illustrated connector system. The socket boot 34 extends over a portion of the second mono socket body 36. In an exemplary implementation, the second boot 34 extends over a portion of the second mono body 36 so as to so as to completely cover and form a liquid-tight seal with regard to the socket-side interconnect face 36B. The socket boot 34 also has a plurality of rupturable features corresponding to the predetermined contact layout of the socket body 36. For instance, each feature may align in register with a corresponding aperture at the socket-side interconnect face 36B. Again, however, initially, there are no holes or other apertures that extend entirely through the socket boot 34. In this regard, the socket boot 34 functions as a seal to seal the rear portion, or wire entry (interconnect end), of the socket connector 30.

The interfacial seal 22 seats between the plug-side connector face 16A of the first mono body, i.e., plug body 16, and the socket-side connector face 36A of the second mono body, i.e., socket body 36. The interfacial seal 22 has a plurality of rupturable features corresponding to the predetermined contact layout. Again, however, initially, there are no holes or other apertures that extend entirely through the interfacial seal 22, as will be described in greater detail herein.

When the plug body 16 is mated with the socket body 36, each pin contact 20 that is installed in the plug connector 10 will have ruptured a correspondingly aligned rupturable feature of the interfacial seal 22. Moreover, as the plug connector 10 and socket connector 30 are tightened together, e.g., via the thumbscrews of the backshells 12, 32, etc., the interfacial seal 22 deforms to prevent contaminants from penetrating between the interface of the plug and socket bodies. Thus, when the plug body 16 is mated with the socket body 36, the above-described seal arrangement prevents water and contaminants from entering the connector and degrading the electrical properties of the connection.

The interfacial seal 22 may be adhered to the plug body 16 and/or the socket body 36, e.g., by an adhesive or some other method such as multi-compound molding, ultrasonic welding, etc.

According to various aspects of the present invention, at least three leak paths are sealed by the arrangements described above. A leak path through the front of the connector between the mating connection of the plug body 16 to the socket body 36 is prevented/resolved by the interfacial seal 22. In an illustrative example, the interfacial seal 22 deforms when the plug body 16 is mated with the socket body 36 so as to form a liquid-tight seal at the interface between the first and second mono bodies. A leak path through the rear, or interconnect/wire end, of each connector half is prevented/resolved by the corresponding boot seal 14, 34. And, a leak path through the body of each connector half is prevented/resolved through the use of a mono body.

Figure 4:
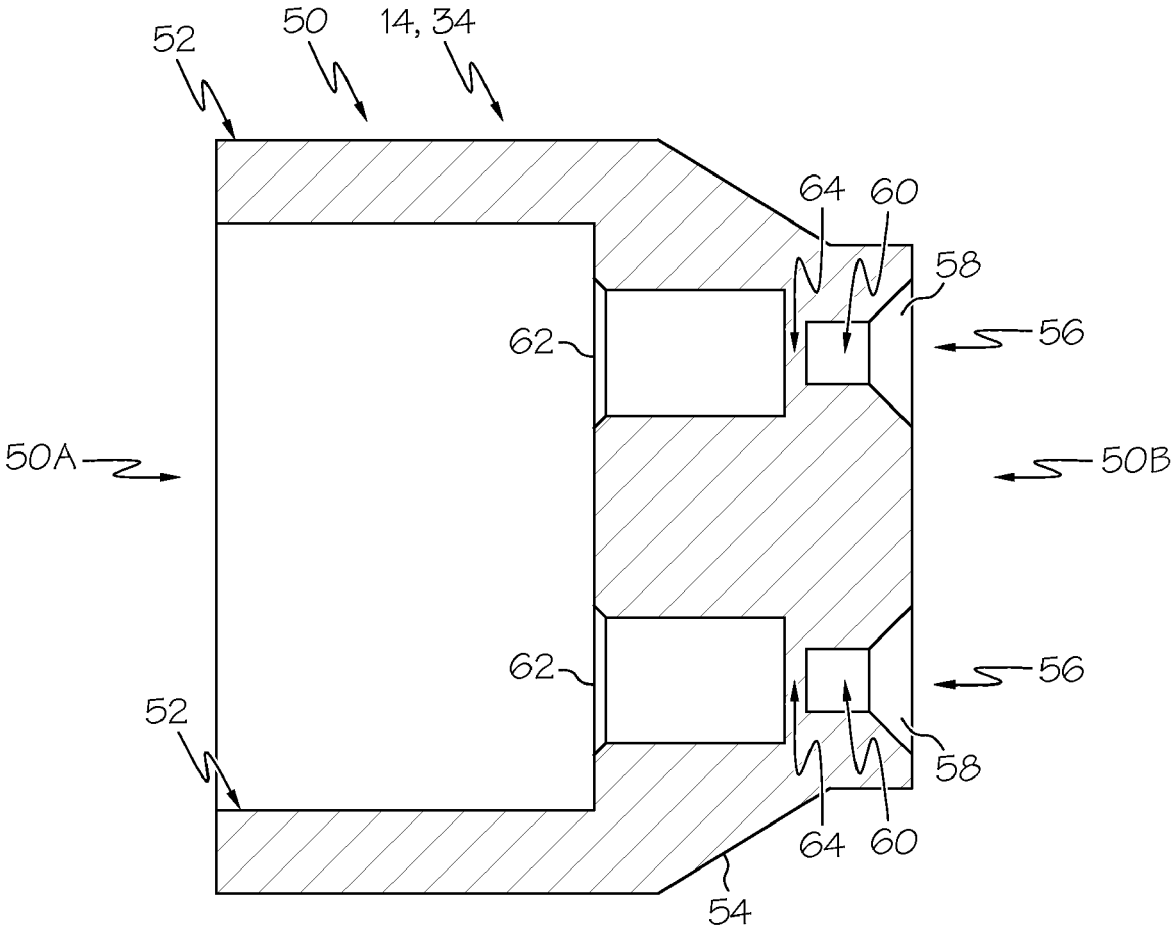
FIG. 4 is a side schematic view of a boot according to various aspects of the present invention.

Referring to FIG. 4, an exemplary implementation of the plug boot 14 and/or socket boot 34 is illustrated, according to various aspects of the present invention. As noted in greater detail herein, initially, there are no through apertures at the positions associated with the contact layout. In this regard, the boots 14, 34, provide protection from water and other contaminants from penetrating to the plug-side cable face 16B or corresponding socket-side interconnect face 36B, respectively. However, the boots 14, 34 include indents corresponding to the contact layout to provide a guide for the user to insert contacts 20/sockets 40 into the proper location when assembling a connector.

Each boot 14, 34 comprises a boot body 50. In an illustrative example, the boot body 50 comprises a flame retardant, silicone rubber material. The boot body 50 includes a connector face 50A that includes a sleeve 52 for receiving the body of the corresponding connector, e.g., the plug body 16 or socket body 36. The boot body 50 also includes a interconnect face 50B facing the wires or other interconnects that couple to the connector.

The boot body 50 defines a seal 54 adjacent to the interconnect face 50 for preventing water and other contaminants from passing through the boot body 50. For instance, the interconnect face 50B includes a plurality of guides 56. As illustrated, the guides 56 pass only partially through the seal 54. The guides 56 correspond to the predetermined contact layout. For instance, as illustrated, each guide 56 includes an opening 58 that tapers in to assist the user to align a corresponding contact, e.g., pin contact 20 or socket contact 40, with an associated guide 56. The opening 58 tapers into a channel 60 having a cross-section that is dimensioned, for example, based upon the diameter of the corresponding pin contact 20, socket contact 40, expected wire gauge or other appropriate factor. Adjacent to each channel 60 is a chamber 62. The chamber 62 aligns with a corresponding aperture through a connector body when the boot body 50 is properly seated on a corresponding connector body.

A rupturable feature, implemented as a rupturable membrane 64, separates and seals each channel 60 from a corresponding chamber 62 such that each rupturable feature, e.g., the membrane 64, is positioned in register with and opposite a corresponding guide 56. As illustrated, each rupturable membrane 64 is positioned between a corresponding guide 56 and an associated chamber 62. However, the rupturable membranes 64 may alternatively be positioned at different locations within the seal 54.

The rupturable membrane 64 ruptures upon inserting a contact, e.g., a pin contact 20 in the case of a boot 14 or a socket contact 40 in the case of a boot 34, through the corresponding channel 60. In this regard, the channel 60 seals around the corresponding wire that passes through the boot to create an environmentally tight seal. The rupturable membrane 64 may comprise, for instance, a layer of rubber material that forms a barricade and prevents water and/or other contaminants from penetrating from the opening 58 to the chamber 62.

According to further aspects of the present invention, each rupturable feature of the boot may be oriented such that if a pin contact 20 or socket contact 36 is inserted so as to rupture the membrane 64, and the contact is subsequently removed, the membrane 64 will pull back and attempt to close or otherwise re-seal the rupturable feature. In this regard, the membrane 64 may be configured to tear but not necessarily shear entirely off. This allows the possibility for the membrane material to pull back and reduce the chance of a leak path, even if a wire that was once installed, is subsequently removed.

Figure 5:
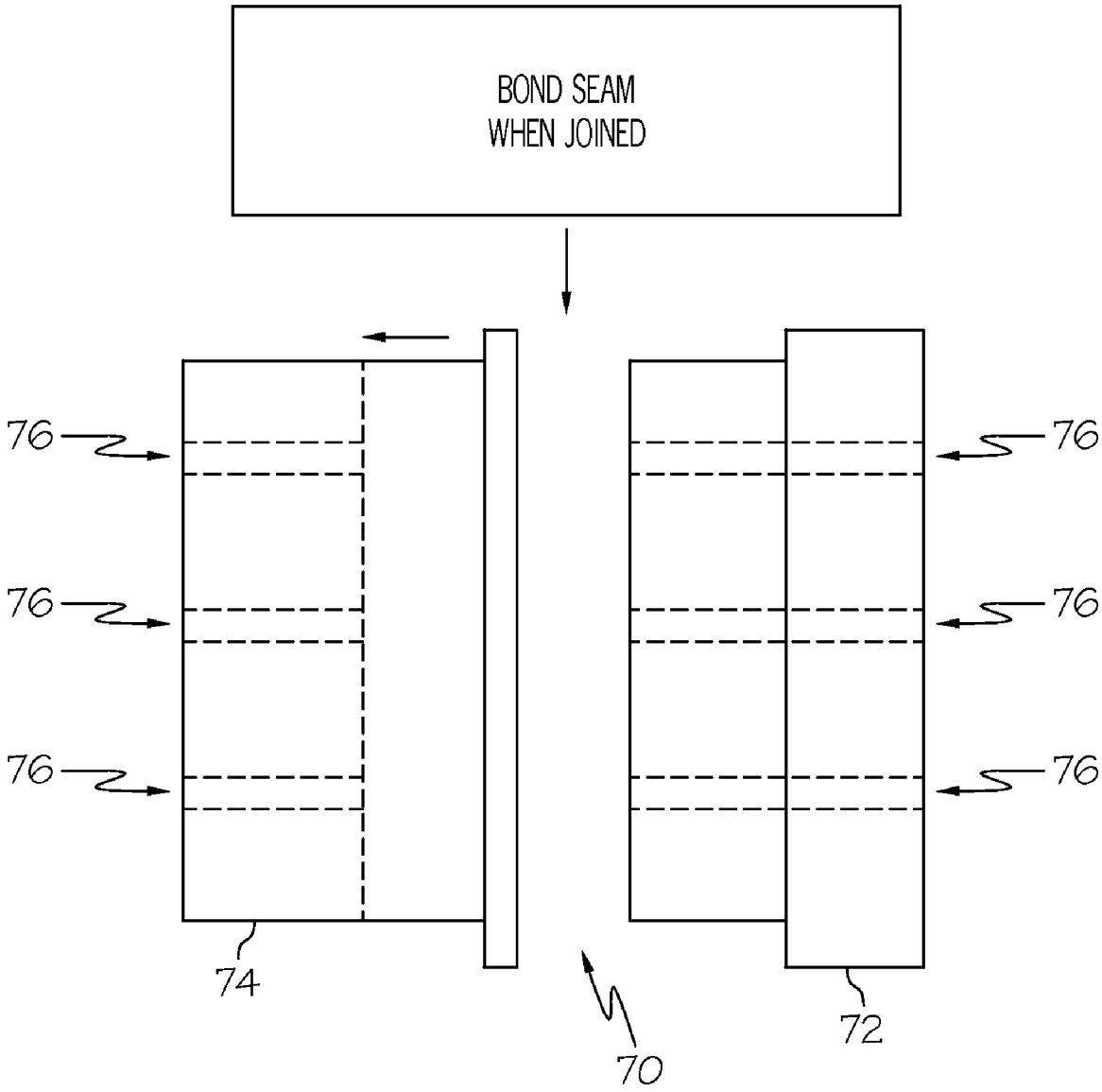
FIG. 5 is an illustration of a two component connector body and a bonding process to form a mono body from the two components, according to various aspects of the present invention.

Referring to FIG. 5, a body 70, e.g., which can be implemented as either the plug body 16 and/or the socket body 20, is illustrated as two components, including a first component 72 and a second component 74 having apertures 76 there through. The apertures 76 define either the apertures 44 or 46 as illustrated in FIG. 3, e.g., depending upon whether the body is implemented as a plug body 16 or socket body 36. To realize a mono body for purposes of an environmentally sealed connector, the first component 72 is mated with the second component 74, and the first and second components 72, 74 are bonded or otherwise joined as an integral unit, such as typically by ultrasonically welding the first component 72 to the second component 74. The ultrasonic weld effectively bonds the first component 72 to the second component 74.

According to various aspects of the present invention, the plug body 16 comprises a mono body that is derived from a first plastic member 72, which includes the plug-side connector face 16A. A second plastic member 74 includes the plug-side interconnect face 16B. The first plastic member is mated 72, and ultrasonically welded to, the second plastic member 74 such that the resultant mono body is environmentally sealed, and thus liquid-tight, around the mating edges that define the first and second plastic members 72, 74. Similarly, the socket body 36 comprises a mono body that is derived from a first plastic member 72, which includes the socket-side connector face 36A. A second plastic member 74 includes the socket-side interconnect face 36B. The first plastic member is mated 72, and ultrasonically welded to, the second plastic member 74 such that the resultant mono body is environmentally sealed around the mating edges that define the first and second plastic members 72, 74.

Figure 6:
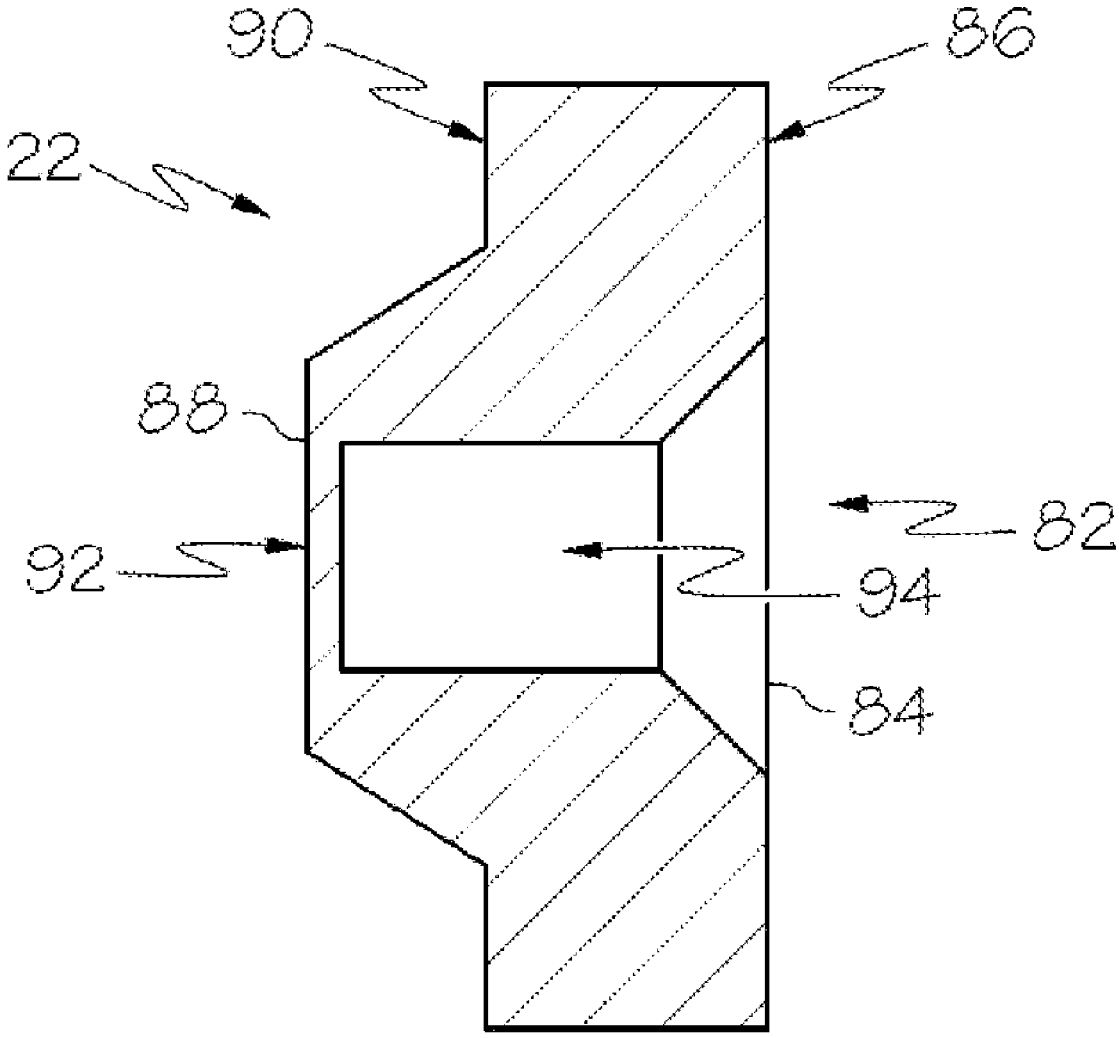
FIG. 6 is a side schematic view of an interfacial seal according to various aspects of the present invention.

Referring to FIG. 6, a portion of the interfacial seal 22 is illustrated according to various aspects of the present invention. In this illustrated view, only a single aperture is illustrated for purposes of clarity of discussion herein. The interfacial seal 22 comprises a rubber material, such as a flame retardant silicone rubber material. In an exemplary implementation, the interfacial seal 22 includes a plurality of rupturable features 82, each feature 82 corresponding to a contact location of an associated contact layout. Each rupturable feature 82 comprises a countersunk guide 84 on a first side 86 of the interfacial seal 22. Each rupturable feature 82 also includes a raised portion 88 opposite the corresponding countersunk guide 84 on a second side 90 opposite the first side 86 of the interfacial seal 22.

The raised portion 88 has a membrane 92 in register with the countersunk guide 84. In this regard, initially, there are no apertures or through holes that extend entirely through the interfacial seal 22. That is, the raised portion 88 seals the rupturable feature 82 via the membrane 92 until a contact is forced through the membrane 92, e.g., such that the membrane 92 tears in a manner that allows the contact to pass through.

According to certain aspects of the present invention, each rupturable feature 82 of the interfacial seal 22 comprises a channel 94 that extends between the membrane 92 and the countersunk guide 84. The channel 94 has a cross-section that is dimensioned, for example, based upon the diameter of the corresponding pin contact 20 or other appropriate factor. As such, the channel 94 may be dimensioned so as to apply a tight fit to a contact 20 that passes there through. According to further aspects of the present invention, the raised portion 88 is oriented towards the plug connector mono body such that if a contact 20 is inserted so as to rupture the membrane 92, and the contact 20 is subsequently removed, the membrane 82 will pull back and close the rupturable feature. However, the opposite orientation may also be implemented.

In this regard, the membrane 92 may be configured to tear but not necessarily shear entirely off. This allows the possibility for the rubber to pull back and reduce the chance of a leak path, even if a contact 20 that was once installed, is subsequently removed. Thus, according to certain aspects of the present invention, the membrane 92 may be able to reduce the likelihood of creating a leak path, e.g., by pulling back and closing the rupturable feature, even if a pin 18 is inserted, and subsequently removed.

Referring to the Figures generally, an electrical connector assembly is provided that utilizes two mating components, including male and female mating connectors, e.g., the plug connector 10 and the socket connector 30. The plug connector includes components including a mono body, a shell, a boot, and an interfacial sealing system. Correspondingly, the socket connector includes a mono body, a shell and a boot. In this manner, an environmentally sealed connector assembly is provided with a sealing system that prevents water and other contaminants from penetrating through to electrically conductive components in a manner that degrades electrical properties and performance of the electrical connector assembly when the connector assembly is assembled. In this manner, the interfacial seal prevents a leak path between the mated halves of the connector assembly, e.g., between the plug connector 10 and the mated socket connector 30 described more fully herein. The boot over the interconnect/cable end of each connector prevents a leak path through the back end of each of the plug connector 10 and socket connector 30. Similarly, each connector body is bonded, e.g., ultrasonically welded to produce a mono body construction that prevents a leak path between components that make up each connector body.

The use of a rubber boot and rubber interfacial seal, enable the environmentally sealed connector assembly to be field repairable. For instance, should a contact or socket get bent and require replacement, the entire connector is not wasted or rendered unusable. Rather, the damaged component(s) can be field replaced and/or repaired. Moreover, the boot 14, 34 and interfacial seal 22 approach provides for a connector that is field reconfigurable to accommodate reconfiguration and modification based upon future electrical design changes. For instance, new contacts, corresponding sockets and associated wiring can be added to contact layout positions that are not currently utilized. In this regard, the rupturable features prevent liquids from penetrating the electrical connections, even where a contact is not inserted into the connector.

The mono body may be based upon a two-piece design by bonding, e.g., ultrasonically welding together, the two plastic pieces that make up the connector body. The back shell component when utilized, cover at least a boot seal that extends over the connector body. The interfacial seal system fills the void between the mating contacts/sockets when corresponding male and female connectors are assembled together. The interfacial seal 22 is held in compression, e.g., when the jack screws of the male and female connector halves are tightened together.

Both the interfacial seal and the boot seal may be comprised of silicone rubber material. Each has break through membranes that are punctured during contact insertion. This feature allows complete sealing when all contacts or sockets are populated, and further allows the connector to be liquid-tight even when less than the entirety of the contacts or sockets are populated.

The above seal prevents water and contaminants from entering the connector and degrading the electrical properties of the connection. In this regard, three leak paths are sealed. A leak path through the front of the connector is resolved by the interfacial seal. A leak path through the rear of the connector is resolved by the boot seals. And, a leak path through the body of the connector is resolved by bonding the body components typically through ultrasonic welding.

However, according to further aspects of the present invention, to provide a liquid-tight seal, the plug half 10 or the socket half 30 of the connector could be mated to a connector that is sealed by some other method. For example the plug connector 10 could be used with a hermitic socket connector of the same contact arrangement and the plug connector 10 will still be sealed. Similarly, the socket connector 30 could be used with a hermetic plug connector of the same contact arrangement and the socket connector 30 will still be sealed, as set out in greater detail herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. A liquid-tight electrical connector comprising:

a plug connector having:

a first mono body defining a plug body having a plug-side connector face, a wire entry side face and a plurality of apertures that pass through the first mono body between the plug-side interconnect face and the plug-side connector face in a pattern corresponding to a predetermined contact layout;

a first boot that extends over a portion of the first mono body so as to completely cover the wire entry side face, the first boot having a plurality of rupturable features, each feature in register with a corresponding aperture at the plug-side interconnect face; and an interfacial seal having a plurality of rupturable features corresponding to the predetermined contact layout; and a socket connector having:

a second mono body defining a socket body having a socket-side connector face, a wire entry side face and a plurality of apertures that pass through the second mono body between the socket-side interconnect face and the socket-side connector face in a pattern complimentary to the corresponding predetermined contact layout;

a second boot that extends over a portion of the second mono body so as to completely cover the wire entry side, the second boot having a plurality of rupturable features, each feature in register with a corresponding aperture at the socket-side interconnect face;

wherein:

the interfacial seal seats between the plug-side connector face of the first mono body and the socket-side connector face of the second mono body and deforms when the plug connector is coupled to the socket connector so as to form a water-tight seal at the interface between the plug body and the socket body.

2. The liquid-tight electrical connector according to claim 1, wherein:

the first boot is adhered to the plug body using at least one of: adhesive, multicompound molding and ultrasonic welding and/or the second boot is adhered to the socket body using at least one of: adhesive, multicompound molding and ultrasonic welding.

3. The liquid-tight electrical connector according to claim 1, wherein:

a water-tight seal is formed to prevent contaminants from penetrating the wire entry side face of the plug body by the combination of the first boot and at least one of: a first backshell that couples to the first mono body so as to cover the first boot and an overmolding that provides the function of the first backshell; and/or a water-tight seal is formed to prevent contaminants from penetrating the wire entry side face of the socket body by the combination of the second boot and at least one of: a second backshell that couples to the second mono body so as to cover the second boot and an overmolding that provides the function of the second backshell.

4. The liquid-tight electrical connector according to claim 1, wherein at least one of the first mono body and the second mono body comprises:

a first plastic member having a connector face; and a second plastic member having an interconnect face; wherein the first plastic member is bonded to the second plastic member such that the resultant mono body is liquid-tight around the mating edges that define the first and second plastic members.

5. The liquid-tight electrical connector according to claim 4, wherein the first plastic member is ultrasonically welded to the second plastic member.

6. The liquid-tight electrical connector according to claim 1, wherein the interfacial seal is adhered to the plug body using at least one of: adhesive, multicompound molding and ultrasonic welding.

7. The liquid-tight electrical connector according to claim 1, wherein:

the interfacial seal comprises a rubber material; and each rupturable feature comprises:

a countersunk guide on a first side of the interfacial seal; and a raised portion opposite the corresponding countersunk guide having a membrane in register with the countersunk guide;

wherein:

the raised portion seals the rupturable feature until a contact is forced through the membrane such that the membrane tears in a manner that allows the contact to pass through.

8. The liquid-tight electrical connector according to claim 7, wherein each of the rupturable features of the interfacial seal comprise a channel that extends between the membrane and the countersunk guide.

9. The liquid-tight electrical connector according to claim 7, wherein the raised portion is oriented towards the plug body, wherein the membranes are configured such that if a contact is inserted so as to rupture the membrane, and the contact is subsequently removed, the membrane will pull back and close the rupturable feature.

10. The liquid-tight electrical connector according to claim 1, wherein the first boot and second boot each comprise:

a silicone rubber boot body having a face having a plurality of guides that extend only partially through the face, the guides corresponding to the predetermined contact layout;

wherein each rupturable feature comprises a membrane that is positioned in register with and opposite a corresponding guide.

11. The liquid-tight electrical connector according to claim 10, wherein the membranes are configured such that if a contact is inserted so as to rupture the membrane, and the contact is subsequently removed, the membrane will pull back and close the rupturable feature.

12. The liquid-tight electrical connector according to claim 1, wherein:

the plug connector further comprises a first backshell that couples to the first mono body so as to cover the first boot; and the socket connector further comprises a second backshell that couples to the second mono body so as to cover the second boot.

13. An environmentally sealed electrical connector comprising:

a two-component plug body having first component including a plug-side connector face bonded to a second component including a wire entry side face to realize a mono body that prevents contaminants from penetrating between the bonded interface of the first and second components;

a plurality of apertures that pass through the plug body between the plug-side interconnect face and the wire entry side face in a pattern corresponding to a predetermined contact layout;

a two-component socket body having first component including a socket-side connector face bonded to a second component including a wire entry side face to realize a mono body that prevents leaks from penetrating between the bonded interface of the first and second components;

a plurality of apertures that pass through the socket body between the socket-side interconnect face and the socket-side connector face in a pattern complimentary to the corresponding predetermined contact layout;

a first boot that extends over a portion of the plug body to prevent contaminants from penetrating through the plug-side interconnect face, the first boot having a plurality of rupturable features, each feature in register with a corresponding aperture at the plug-side interconnect face;

a first backshell that couples to the plug body so as to cover the first boot;

a second boot that extends over a portion of the socket body to prevent contaminants from penetrating through the socket-side interconnect face, the second boot having a plurality of rupturable features, each feature in register with a corresponding aperture at the socket-side interconnect face;

a second backshell that couples to the socket body so as to cover the second boot; and an interfacial seal that seats between the plug-side connector face of the plug body and the socket-side connector face of the socket body, the interfacial seal having a plurality of rupturable features corresponding to the predetermined contact layout, such that when the plug body is mated with the socket body, the interfacial seal deforms to prevent contaminants from penetrating between the interface of the plug and socket bodies.

14. The environmentally sealed electrical connector according to claim 13, wherein:

the interfacial seal comprises a rubber material; and each rupturable feature comprises:

a countersunk guide on a first side of the interfacial seal; and a raised portion opposite the corresponding countersunk guide having a membrane in register with the countersunk guide;

wherein:

the raised portion seals the rupturable feature until a contact is forced through the membrane such that the membrane tears in a manner that allows the contact to pass through.

15. The environmentally sealed electrical connector according to claim 14, wherein the rupturable features of the interfacial seal comprise a channel that extends between the membrane and the countersunk guide that is dimensioned so as to apply a tight fit.

16. The environmentally sealed electrical connector according to claim 15, wherein the raised portion is oriented towards the plug body, wherein the membranes are configured such that if a pin contact is inserted so as to rupture the membrane, and the pin contact is subsequently removed, the membrane will pull back and close the rupturable feature.

17. The environmentally sealed electrical connector according to claim 13, wherein the first boot and second boot each comprise:

a silicone rubber boot body having a face having a plurality of guides that extend only partially through the face, the guides corresponding to the predetermined contact layout;

wherein each rupturable feature comprises a membrane that is positioned in register with and opposite a corresponding guide; and each boot is adhered to the corresponding body using at least one of: adhesive, multicompound molding and ultrasonic welding.

18. The environmentally sealed electrical connector according to claim 17, wherein each rupturable feature is oriented such that if the membrane is ruptured, the membrane is configured to close if a wire that passes through the membrane is removed.

19. A liquid-tight electrical connector comprising:

a selected one of a plug connector and a socket connector, wherein:

the plug connector has:

a first mono body defining a plug body having a plug-side connector face, a wire entry side face and a plurality of apertures that pass through the first mono body between the plug-side interconnect face and the plug-side connector face in a pattern corresponding to a predetermined contact layout;

a first boot that extends over a portion of the first mono body so as to completely cover the wire entry side face, the first boot having a plurality of rupturable features, each feature in register with a corresponding aperture at the plug-side interconnect face; and an interfacial seal having a plurality of rupturable features corresponding to the predetermined contact layout; and the socket connector has:

a second mono body defining a socket body having a socket-side connector face, a wire entry side face and a plurality of apertures that pass through the second mono body between the socket-side interconnect face and the socket-side connector face in a pattern complimentary to the corresponding predetermined contact layout;

a second boot that extends over a portion of the second mono body so as to completely cover the wire entry side, the second boot having a plurality of rupturable features, each feature in register with a corresponding aperture at the socket-side interconnect face;

wherein:

the selected one of the plug connector and socket connector is mated with a complimentary connector half that is sealed liquid-tight.

20. The liquid-tight electrical connector according to claim 19, wherein:

the complementary connector half is hermetically sealed.

* * * * *